US009103641B2

(12) United States Patent
Nielson et al.

(10) Patent No.: US 9,103,641 B2
(45) Date of Patent: Aug. 11, 2015

(54) REACTIVE MATERIAL ENHANCED PROJECTILES AND RELATED METHODS

(75) Inventors: Daniel B. Nielson, Tremonton, UT (US); Richard M. Truitt, Champlin, MN (US); Benjamin N. Ashcroft, Perry, UT (US)

(73) Assignee: Orbital ATK, Inc., Dulles, VA (US)

( * ) Notice: Subject to any disclaimer, the term of this patent is extended or adjusted under 35 U.S.C. 154(b) by 0 days.

(21) Appl. No.: 13/372,804

(22) Filed: Feb. 14, 2012

(65) Prior Publication Data

US 2012/0167793 A1 Jul. 5, 2012

Related U.S. Application Data

(63) Continuation of application No. 11/538,763, filed on Oct. 4, 2006, now Pat. No. 8,122,833.

(60) Provisional application No. 60/723,465, filed on Oct. 4, 2005.

(51) Int. Cl.

| | |
|---|---|
| ***F42B 12/74*** | (2006.01) |
| ***F42B 12/44*** | (2006.01) |
| ***F42B 12/06*** | (2006.01) |

(Continued)

(52) U.S. Cl.

CPC ..... *F42B 12/74* (2013.01); *C06B 45/00* (2013.01); *C06B 45/12* (2013.01); *F42B 12/204* (2013.01); *F42B 12/44* (2013.01); *F42B 12/06* (2013.01)

(58) Field of Classification Search

CPC ..... F42B 12/20; F42B 12/44; F42B 12/74; C06B 45/00; C06B 45/12; C06B 45/14; C06B 45/16

USPC ..... 102/364, 516, 517, 518, 501

See application file for complete search history.

(56) References Cited

U.S. PATENT DOCUMENTS

| | | | |
|---|---|---|---|
| 359,491 | A | 3/1887 | Bagger |
| 1,819,106 | A | 8/1931 | McBride et al. |

(Continued)

FOREIGN PATENT DOCUMENTS

| | | | |
|---|---|---|---|
| DE | 315857 | C | 6/1920 |
| DE | 2306872 | A1 | 8/1974 |

(Continued)

OTHER PUBLICATIONS

3M Material Safety Data Sheet pp. 1-7 © 2005 3M Company.

(Continued)

*Primary Examiner* — James S Bergin
(74) *Attorney, Agent, or Firm* — TraskBritt

(57) ABSTRACT

A munition, such as a projectile formed of at least one reactive material. In one embodiment, the projectile includes a body portion formed of at least one reactive material composition wherein the at least one reactive material composition defines at least a portion of an exterior surface of the projectile. In other words, a portion of the reactive material may be left "unbuffered" or exposed to the barrel of a gun or weapon from which it is launched and similarly exposed to a target with which the projectile subsequently impacts. In one embodiment, the projectile may be formed with a jacket surrounding a portion of the reactive material to provide additional structural integrity. The projectile may be formed by casting or pressing the reactive material into a desired shape, or the reactive material may be extruded into a near-net shape and then machined into the desired shape.

29 Claims, 3 Drawing Sheets

(51) Int. Cl.

| | |
|---|---|
| ***C06B 45/12*** | (2006.01) |
| ***C06B 45/00*** | (2006.01) |
| ***F42B 12/20*** | (2006.01) |

(56) References Cited

U.S. PATENT DOCUMENTS

| | | | | | |
|---|---|---|---|---|---|
| 2,217,645 | A | | 10/1940 | DeWilde et al. | |
| 2,326,147 | A | | 8/1943 | Landen | |
| 2,359,317 | A | | 10/1944 | Landen | |
| 2,398,287 | A | | 4/1946 | Christie | |
| 2,424,970 | A | | 8/1947 | Church et al. | |
| 2,425,005 | A | | 8/1947 | Reehel | |
| 2,425,418 | A | | 8/1947 | Burdett et al. | |
| 2,446,268 | A | | 8/1948 | Dawson | |
| 2,459,175 | A | | 1/1949 | Moore | |
| 2,532,323 | A | * | 12/1950 | Miller, Jr. | 102/364 |
| 2,703,531 | A | | 3/1955 | Graumann et al. | |
| 2,961,712 | A | | 11/1960 | Davis | |
| 2,972,948 | A | | 2/1961 | Kray | |
| 3,028,808 | A | * | 4/1962 | Porter et al. | 102/364 |
| 3,133,841 | A | | 5/1964 | Kuehl | |
| 3,158,994 | A | | 12/1964 | Hodgson | |
| 3,191,535 | A | | 6/1965 | Mulloy | |
| 3,235,005 | A | | 2/1966 | Delacour | |
| 3,325,316 | A | | 6/1967 | MacDonald | |
| 3,348,484 | A | | 10/1967 | Grandy | |
| 3,414,443 | A | | 12/1968 | Pheasant | |
| 3,434,420 | A | | 3/1969 | Ciccone et al. | |
| 3,463,047 | A | | 8/1969 | Germershausen | |
| 3,669,020 | A | | 6/1972 | Waite et al. | |
| 3,675,575 | A | | 7/1972 | Bailey et al. | |
| 3,677,183 | A | | 7/1972 | Talley | |
| 3,730,093 | A | | 5/1973 | Cummings | |
| 3,745,076 | A | | 7/1973 | Sickman et al. | |
| 3,770,525 | A | | 11/1973 | Villey-Desmeserets et al. | |
| 3,799,054 | A | | 3/1974 | LaRocca | |
| 3,894,867 | A | | 7/1975 | Fishman et al. | |
| 3,951,068 | A | | 4/1976 | Schroeder | |
| 3,961,576 | A | | 6/1976 | Montgomery | |
| 3,978,796 | A | | 9/1976 | Hackman | |
| 3,980,612 | A | | 9/1976 | Gangal | |
| 4,006,687 | A | | 2/1977 | Ridgeway | |
| 4,011,818 | A | | 3/1977 | Stosz | |
| 4,029,868 | A | | 6/1977 | Carlson | |
| 4,037,539 | A | | 7/1977 | Hackman | |
| 4,094,246 | A | | 6/1978 | Travor | |
| 4,096,804 | A | | 6/1978 | Bilsbury | |
| 4,106,411 | A | | 8/1978 | Borcher et al. | |
| 4,112,846 | A | | 9/1978 | Gilbert | |
| 4,131,498 | A | | 12/1978 | Lucy | |
| 4,153,661 | A | | 5/1979 | Ree et al. | |
| 4,179,992 | A | | 12/1979 | Ramnarace et al. | |
| 4,237,787 | A | | 12/1980 | Wacula et al. | |
| 4,280,408 | A | | 7/1981 | Weber et al. | |
| 4,331,080 | A | | 5/1982 | West | |
| 4,348,958 | A | | 9/1982 | Day | |
| 4,351,240 | A | | 9/1982 | McCubbin et al. | |
| 4,368,296 | A | | 1/1983 | Kuhls et al. | |
| 4,381,692 | A | | 5/1983 | Weintraub | |
| 4,383,485 | A | | 5/1983 | Coates et al. | |
| 4,419,936 | A | | 12/1983 | Coates et al. | |
| 4,432,816 | A | | 2/1984 | Kennedy et al. | |
| 4,435,481 | A | | 3/1984 | Baldi | |
| 4,444,112 | A | * | 4/1984 | Strandli et al. | 102/364 |
| 4,445,947 | A | | 5/1984 | Shaw | |
| 4,449,456 | A | | 5/1984 | Foss et al. | |
| 4,462,312 | A | * | 7/1984 | Cahannes et al. | 102/364 |
| 4,503,776 | A | | 3/1985 | Nussbaum et al. | |
| 4,572,077 | A | | 2/1986 | Antoine et al. | |
| 4,612,860 | A | | 9/1986 | Flatau | |
| 4,625,650 | A | * | 12/1986 | Bilsbury | 102/516 |
| 4,655,139 | A | | 4/1987 | Wilhelm | |
| 4,662,280 | A | | 5/1987 | Becker et al. | |
| 4,665,113 | A | | 5/1987 | Eberl | |
| 4,693,181 | A | | 9/1987 | Dadley et al. | |
| 4,702,171 | A | | 10/1987 | Tal et al. | |
| 4,747,892 | A | | 5/1988 | Spencer | |
| 4,766,813 | A | | 8/1988 | Winter et al. | |
| H000540 | H | | 11/1988 | Caponi | |
| 4,807,795 | A | | 2/1989 | LaRocca | |
| 4,853,294 | A | | 8/1989 | Everett et al. | |
| 4,955,939 | A | | 9/1990 | Petrousky et al. | |
| 4,958,570 | A | | 9/1990 | Harris | |
| 4,970,960 | A | | 11/1990 | Feldmann | |
| 4,985,190 | A | | 1/1991 | Ishikawa et al. | |
| 5,045,114 | A | | 9/1991 | Bigalk et al. | |
| 5,049,212 | A | | 9/1991 | Colick | |
| 5,055,539 | A | | 10/1991 | Hengel et al. | |
| 5,067,995 | A | | 11/1991 | Nutt | |
| 5,083,615 | A | | 1/1992 | McLaughlin et al. | |
| H1047 | H | | 5/1992 | Henderson et al. | |
| 5,121,691 | A | | 6/1992 | Nicolas | |
| 5,133,259 | A | * | 7/1992 | Schluckebier | 102/364 |
| 5,157,225 | A | | 10/1992 | Adams et al. | |
| 5,175,392 | A | | 12/1992 | Denis | |
| 5,198,616 | A | | 3/1993 | Anderson | |
| 5,212,343 | A | | 5/1993 | Brupbacher et al. | |
| 5,259,317 | A | | 11/1993 | Lips | |
| 5,313,890 | A | | 5/1994 | Cuadros | |
| 5,323,707 | A | | 6/1994 | Norton | |
| 5,339,624 | A | | 8/1994 | Calsson | |
| 5,347,907 | A | | 9/1994 | Strandli et al. | |
| 5,411,615 | A | | 5/1995 | Sumrail et al. | |
| H1504 | H | | 12/1995 | Crabtree | |
| 5,472,536 | A | | 12/1995 | Doris | |
| 5,474,625 | A | | 12/1995 | Duong et al. | |
| 5,518,807 | A | | 5/1996 | Chan et al. | |
| 5,531,844 | A | | 7/1996 | Brown | |
| 5,535,679 | A | | 7/1996 | Craddock | |
| 5,549,948 | A | | 8/1996 | Blong et al. | |
| 5,561,260 | A | | 10/1996 | Towning et al. | |
| 5,585,594 | A | | 12/1996 | Pelham et al. | |
| 5,627,339 | A | | 5/1997 | Brown | |
| 5,652,408 | A | | 7/1997 | Nicolas | |
| 5,672,843 | A | | 9/1997 | Evans | |
| 5,710,217 | A | | 1/1998 | Blong et al. | |
| 5,721,392 | A | | 2/1998 | Chan et al. | |
| 5,763,519 | A | | 6/1998 | Springsteen | |
| 5,792,977 | A | | 8/1998 | Chawla | |
| 5,801,325 | A | | 9/1998 | Willer et al. | |
| 5,811,726 | A | | 9/1998 | Brown | |
| 5,852,256 | A | | 12/1998 | Hornig | |
| 5,886,293 | A | | 3/1999 | Nauflett et al. | |
| 5,910,638 | A | | 6/1999 | Spencer | |
| 5,913,256 | A | | 6/1999 | Lowden et al. | |
| 5,945,629 | A | | 8/1999 | Schildknecht et al. | |
| 5,997,668 | A | | 12/1999 | Aubert et al. | |
| 6,012,392 | A | | 1/2000 | Norman et al. | |
| 6,021,714 | A | | 2/2000 | Grove et al. | |
| 6,042,702 | A | | 3/2000 | Kolouch et al. | |
| 6,105,505 | A | | 8/2000 | Jones | |
| 6,115,894 | A | | 9/2000 | Huffman | |
| 6,119,600 | A | | 9/2000 | Burri | |
| 6,132,536 | A | | 10/2000 | Hohmann et al. | |
| 6,186,072 | B1 | | 2/2001 | Hickerson, Jr. et al. | |
| 6,293,201 | B1 | | 9/2001 | Consaga | |
| 6,308,634 | B1 | | 10/2001 | Fong | |
| 6,315,847 | B1 | | 11/2001 | Lee et al. | |
| 6,334,394 | B1 | | 1/2002 | Zimmermann et al. | |
| 6,354,222 | B1 | * | 3/2002 | Becker et al. | 102/513 |
| 6,363,828 | B1 | | 4/2002 | Sherlock et al. | |
| 6,371,219 | B1 | | 4/2002 | Collins et al. | |
| 6,427,599 | B1 | | 8/2002 | Posson et al. | |
| 6,439,315 | B2 | | 8/2002 | Onuki | |
| 6,446,558 | B1 | | 9/2002 | Peker et al. | |
| 6,484,642 | B1 | | 11/2002 | Kuhns et al. | |
| 6,485,586 | B1 | | 11/2002 | Gill et al. | |
| 6,536,351 | B2 | | 3/2003 | Bocker | |
| 6,547,993 | B1 | | 4/2003 | Joshi | |
| 6,588,344 | B2 | | 7/2003 | Clark | |
| 6,593,410 | B2 | | 7/2003 | Nielson et al. | |
| 6,635,130 | B2 | | 10/2003 | Koch | |
| 6,659,013 | B1 | | 12/2003 | Kellner | |
| 6,679,176 | B1 | | 1/2004 | Zavitsanos et al. | |

(56) References Cited

U.S. PATENT DOCUMENTS

| | | | | |
|---|---|---|---|---|
| 6,691,622 | B2 * | 2/2004 | Zavitsanos et al. | 102/364 |
| 6,799,518 | B1 | 10/2004 | Williams | |
| 6,832,740 | B1 | 12/2004 | Ransom | |
| 6,846,372 | B1 | 1/2005 | Guirguis | |
| 6,896,751 | B2 | 5/2005 | Posson et al. | |
| 6,945,175 | B1 | 9/2005 | Gotzmer et al. | |
| 6,962,634 | B2 | 11/2005 | Nielson et al. | |
| 7,000,547 | B2 | 2/2006 | Amick | |
| 7,017,496 | B2 | 3/2006 | Lloyd | |
| 7,040,235 | B1 | 5/2006 | Lloyd | |
| 7,143,698 | B2 | 12/2006 | Lloyd | |
| 7,191,709 | B2 | 3/2007 | Nechitailo | |
| 7,194,961 | B1 | 3/2007 | Nechitailo | |
| 7,231,876 | B2 | 6/2007 | Kellner | |
| 7,278,353 | B2 | 10/2007 | Langan et al. | |
| 7,278,354 | B1 | 10/2007 | Langan et al. | |
| 7,307,117 | B2 | 12/2007 | Nielson et al. | |
| 7,380,503 | B2 | 6/2008 | Williams et al. | |
| 7,568,432 | B1 * | 8/2009 | Baker et al. | 102/364 |
| 7,603,951 | B2 * | 10/2009 | Rose et al. | 102/364 |
| 7,614,348 | B2 | 11/2009 | Truitt et al. | |
| 7,621,222 | B2 | 11/2009 | Lloyd | |
| 7,891,297 | B1 | 2/2011 | Rohr | |
| 2001/0003295 | A1 | 6/2001 | Langlotz et al. | |
| 2002/0017214 | A1 | 2/2002 | Jacoby et al. | |
| 2002/0112564 | A1 | 8/2002 | Leidel | |
| 2003/0037692 | A1 | 2/2003 | Liu | |
| 2003/0037693 | A1 | 2/2003 | Wendt et al. | |
| 2003/0051629 | A1 | 3/2003 | Zavitsanos et al. | |
| 2003/0140811 | A1 | 7/2003 | Bone | |
| 2004/0020397 | A1 | 2/2004 | Nielson et al. | |
| 2004/0116576 | A1 | 6/2004 | Nielson et al. | |
| 2005/0011395 | A1 | 1/2005 | Langan et al. | |
| 2005/0067072 | A1 | 3/2005 | Vavrick | |
| 2005/0087088 | A1 | 4/2005 | Lacy et al. | |
| 2005/0183618 | A1 | 8/2005 | Nechitailo | |
| 2005/0199323 | A1 | 9/2005 | Nielson et al. | |
| 2006/0011086 | A1 | 1/2006 | Rose et al. | |
| 2006/0086279 | A1 | 4/2006 | Lloyd | |
| 2006/0144281 | A1 | 7/2006 | Williams et al. | |
| 2007/0272112 | A1 | 11/2007 | Nielson et al. | |
| 2007/0277914 | A1 | 12/2007 | Hugus et al. | |
| 2008/0035007 | A1 | 2/2008 | Nielson et al. | |
| 2008/0202373 | A1 | 8/2008 | Hugus | |
| 2008/0229963 | A1 * | 9/2008 | Nielson et al. | 102/364 |
| 2009/0211484 | A1 | 8/2009 | Truitt et al. | |
| 2009/0301337 | A1 * | 12/2009 | Wilson et al. | 102/364 |
| 2009/0320711 | A1 | 12/2009 | Lloyd | |
| 2012/0167793 | A1 * | 7/2012 | Nielson et al. | 102/364 |

FOREIGN PATENT DOCUMENTS

| | | | |
|---|---|---|---|
| DE | 3240310 | A1 | 6/1983 |
| DE | 10224503 | A1 | 12/2002 |
| EP | 0051375 | B1 | 1/1989 |
| EP | 0487472 | A1 | 5/1992 |
| EP | 0487473 | A1 | 5/1992 |
| EP | 0684938 | B1 | 12/1995 |
| EP | 0770449 | A1 | 5/1997 |
| EP | 1348683 | A2 | 10/2003 |
| FR | 856233 | A | 6/1940 |
| FR | 2749382 | A1 | 12/1997 |
| GB | 384966 | A | 12/1932 |
| GB | 488909 | A | 7/1938 |
| GB | 588671 | A | 5/1947 |
| GB | 839872 | A | 6/1960 |
| GB | 968507 | A | 9/1964 |
| GB | 1007227 | A | 10/1965 |
| GB | 1591092 | A | 6/1981 |
| GB | 2295664 | | 6/1996 |
| RU | 2100763 | C1 | 12/1997 |
| WO | 9321135 | A1 | 10/1993 |
| WO | 9607700 | A1 | 3/1996 |
| WO | 9918050 | A1 | 4/1999 |
| WO | 0062009 | A1 | 10/2000 |
| WO | 0177607 | A1 | 10/2001 |
| WO | 0200741 | A1 | 1/2002 |
| WO | 0240213 | A1 | 5/2002 |

OTHER PUBLICATIONS

DuPont Fluoropolymers Food Processing and Industrial Bakeware Coatings http://www.dupont.com/teflon/bakeware/power.html © 2003 E.I. DuPont de Nemours and Company.

DuPont Teflon® Industrial Coatings http://www.dupont.com/teflon/coatings/basic_types.html © 2003 E.I. DuPont de Nemours and Company.

Fischer S.H. et al. "Theoretical Energy Release of Thermites Intermetallics and Combustible Metals" To be presented at the 24th International Pyrotechnics Seminar Monterey CA Jul. 1998 61 pages.

French Search Report dated Oct. 18, 2007 for French Patent Application No. FR 0502373.

French Search Report dated Oct. 24 2007 for French Patent Application No. FR 0502374.

Hackh'S Chemical Dictionary 4th Ed. Dec. 4, 1974 p. 663.

Indium Corporation of America Europe and Asia Indalloy Speciality Alloys Mechanical Properties as viewed at www.indium.com on Aug. 7, 2006.

International Preliminary Report on Patentability for PCT/GB2004/004256, dated Apr. 10, 2006.

International Search Report and Written Opinion for PCT/GB2004/004256, dated Feb. 28, 2005.

Jacobi et al., "Electrical properties of beta phase NiAl," J. Phys. Chem. Solids, 1696, vol. 30, pp. 1261-1271, Pergamon Press, printed in Great Britain.

Jacobi et al., "Optical properties of ternary beta electronphases based on NiAlJ," J. Phys. Chem. Solids, 1973, vol. 34, pp. 1737-1748, Pergamon Press, Printed in Great Britain.

Lycos Wired News Adding More Bang to Navy Missiles 5 pages Dec. 26, 2002 http://wired.com.

Massalski et al., "Electronic structures of hume-rothery phases," Progress in Material Sciences, 1978, vol. 22, pp. 151-155.

Partial European Search Report for European Application No. 03006174.1, dated Jul. 20, 2004, 7 pages.

Partial European Search Report for European Application No. 06020829 dated Oct. 30, 2007, 2 pages.

Patriot Advanced Capability-3 (PAC-3) 17 pages Various Dates as viewed at http://www.missilethreat.com on Nov. 27, 2006.

Patriot Air & Missile Defense System: How Patriot Works http://static.howstuftworks.com © 2002 Raytheon Company.

PCT International Search Report for International Application No. PCT/US2007/076672 mailed Jul. 28, 2008.

Reactive Materials Advanced Energetic Materials (2004) http://www.nap.com © 2004 The National Academy of Sciences pp. 20-23.

Reactive Tungsten Alloy for Inert Warheads Navy SBIR FY2004.2 1 page.

Search Report dated Nov. 8, 2005 prepared by the EPO for the French Patent Office.

SpaceRef.com Better Warheads Through Plastics from Defense Advanced Research Projects Agency (DARPA) 2 pages Dec. 2, 2002 http://www.spaceref.com.

The Ordnance Shop Sidewinder Guided Missile 3 pages as viewed at http://www.ordnance.org on Jul. 26, 2006.

UK Search Report for United Kingdom Application No. GB0505223.8, dated Jun. 30, 2005, 1 page.

UK Search Report for United Kingdom Application No. GB 0505222.0, dated Jun. 29, 2005, 1 page.

UK Search Report for United Kingdom Application No. GB0505220.4, dated Jun. 8, 2005, 1 page.

Zumdahl Steven S. Chemistry Polymers pp. 931-934 (no date).

U.S. Appl. No. 10/801,946, filed Mar. 15, 2004, entitled Reactive Compositions Including Metal and Methods of Forming Same.

(56) References Cited

OTHER PUBLICATIONS

Fischer et al., "A survey in combustible metals, thermites, and intermetallics for pyrotechnic applications", published by Sandia National Laboratories (SAND 95-3448C), presente at AIAA/ASME/SAE/ASEE Joint Propulsion Conference, Lake Buena Vista, FL. Jul. 1-3, 1996, pp. 1-13.

* cited by examiner

REACTIVE MATERIAL ENHANCED PROJECTILES AND RELATED METHODS

CROSS-REFERENCE TO RELATED APPLICATIONS

This application is a continuation of U.S. patent application Ser. No. 11/538,763, filed Oct. 4, 2006, now U.S. Pat. No. 8,122,833, issued Feb. 28, 2012, which patent application claims the benefit of U.S. provisional patent application Ser. No. 60/723,465, filed Oct. 4, 2005.

The present application is related to U.S. Provisional Patent Application No. 60/368,284, filed Mar. 28, 2002, entitled Low Temperature, Extrudable, High Density Reactive Materials; U.S. Pat. No. 6,962,634, issued Nov. 8, 2005, entitled Low Temperature, Extrudable, High Density Reactive Materials; U.S. patent application Ser. No. 12/507,605, filed Jul. 22, 2009, entitled Low Temperature, Extrudable, High Density Reactive Materials, pending; U.S. Provisional Patent Application No. 60/184,316, filed Feb. 23, 2000, entitled High Strength Reactive Materials; U.S. Pat. No. 6,593,410, issued Jul. 15, 2003, entitled High Strength Reactive Materials; U.S. Pat. No. 7,307,117, issued Dec. 11, 2007, entitled High Strength Reactive Materials and Methods of Making; U.S. patent application Ser. No. 10/801,946, filed Mar. 15, 2004, entitled Reactive Compositions Including Metal and Methods of Forming Same, now abandoned; U.S. patent application Ser. No. 11/620,205, filed Jan. 5, 2007, now U.S. Pat. No. 8,075,715, issued Dec. 13, 2011, entitled Reactive Compositions Including Metal; U.S. Provisional Application No. 60/553,430, filed Mar. 15, 2004, entitled Reactive Material Enhanced Projectiles and Related Methods; U.S. Pat. No. 7,603,951, issued Oct. 20, 2009, entitled Reactive Material Enhanced Projectiles and Related Methods; U.S. patent application Ser. No. 10/801,948, filed Mar. 15, 2004, entitled Reactive Material Enhanced Munition Compositions and Projectiles Containing Same, now abandoned; U.S. patent application Ser. No. 12/127,627, filed May 27, 2008, entitled Reactive Material Enhanced Munition Compositions and Projectiles Containing Same, now U.S. Pat. No. 8,568,541, issued Oct. 29, 2013; U.S. Pat. No. 7,614,348, issued Nov. 10, 2009, entitled Weapons and Weapon Components Incorporating Reactive Materials and Related Methods; U.S. patent application Ser. No. 11/697,005, filed Apr. 5, 2007, entitled Consumable Reactive Material Fragments, Ordnance Incorporating Structures for Producing the Same, and Methods of Creating the Same, pending; and U.S. patent application Ser. No. 11/690,016, filed Mar. 22, 2007, now U.S. Pat. No. 7,977,420, issued Jul. 12, 2011, entitled Reactive Material Compositions, Shot Shells Including Reactive Materials, and a Method of Producing Same.

The disclosure of each of the foregoing patents and patent applications is hereby incorporated herein in its entirety by reference.

TECHNICAL FIELD

The present invention, in various embodiments, is related to reactive material enhanced projectiles and, more particularly, to projectiles including incendiary or explosive compositions, the projectiles providing improved reaction characteristics in various applications.

BACKGROUND

There are numerous designs of projectiles containing incendiary or explosive compositions. Such projectiles are conventionally configured such that the incendiary or explosive composition becomes ignited upon, or shortly after, the projectile's contact with an intended target. Ignition of the incendiary or explosive composition is intended to inflict additional damage on the target (i.e., beyond that which is caused by the physical impact of the projectile with the target). Such additional damage may result from the pressure of the explosion, the burning of the composition, or both. Depending on the configuration of the projectile, ignition of the incendiary or explosive composition may also be accompanied by fragmentation of the projectile casing thereby providing additional shrapnel-like components that spread out to create a larger area of impact and destruction.

Some exemplary projectiles containing an incendiary or explosive composition are described in U.S. Pat. No. 4,419,936 to Coates et al. The Coates patent generally discloses a ballistic projectile having one or more chambers containing a material that is explosive, hypergolic, incendiary or otherwise reactive or inert. The material may be a liquid, a semi-liquid, a slurry or of solid consistency. Initially, the material is hermetically sealed within a casing of the projectile but is released upon impact of the projectile with a target causing the projectile casing to become fragmented.

In many cases, projectiles containing an incendiary or explosive composition are designed to provide increased penetration of the projectile into a given target such as, for example, an armored vehicle. One such projectile is the MK211 armor piercing incendiary (API), a projectile that is configured for penetration of armor plating. However, the MK211 and similar projectiles have proven to be relatively ineffective against what may be termed thin-skinned targets. Thin-skinned targets may include, for example, liquid filled fuel tanks or other similar structures having a wall thickness of, for example, about 0.25 inch or less. Thin-skinned targets may further include cars, aircraft, boats, incoming missiles or projectiles, or buildings.

Use of conventional API's or other projectiles configured for penetration of armored structures often fail to inflict any damage on thin-skinned targets other than the initial penetration opening resulting from the impact of the projectile with the target. This is often because such projectiles are configured as penetrating structures with much of projectile being dedicated to penetrating rods or other similar structures. As such, these types of projectiles contain a relatively small amount of incendiary or explosive composition therein because the volume needed for larger amounts of such material is consumed by the presence of the penetrating structure. Thus, because such penetrating projectiles contain relatively small amounts of incendiary or explosive materials, the resultant explosions or reactions are, similarly, relatively small.

Moreover, penetrating projectiles conventionally have a relatively strong housing in which the reactive material is disposed. Thus, a relatively substantial impact is required to breach the housing and ignite the reactive material or energetic composition contained therein. The impact of such a projectile with a so-called thin-skinned target is often below the threshold required to breach the housing and cause a reaction of the composition contained therein.

One exemplary projectile that is designed for discrimination between an armored-type target and a thin-skinned target includes that which is described in U.S. Patent Application Publication Number 20030140811. This projectile includes one or more sensors, such as a piezoelectric crystal, that are configured to determine the rate of deceleration of the projectile upon impact with a target. The rate of deceleration will differ depending on whether an armored-type target or a thin-skinned target is being struck. For example, the rate of deceleration of the projectile will be relatively greater (i.e., it will decelerate more quickly) if the projectile strikes an armored target than if it strikes a thin-skinned target. Upon determining the rate of deceleration, a fuse will ignite an incendiary or explosive composition at an optimized time in order to effectively increase the damage to the specific target depending on what type of target is being impacted.

While the projectile disclosed in the US20030140811 publication provides an incendiary or explosive projectile that may provide some effectiveness against thin-skinned targets, the projectile disclosed thereby is a complex structure requiring numerous components and would likely be prohibitively expensive and difficult to fabricate for use in large numbers as is the case with automatic weapons.

BRIEF SUMMARY OF THE INVENTION

The present invention provides, in certain embodiments, a projectile comprising a reactive material including, for example, an incendiary, explosive or pyrotechnic composition wherein the projectile may be tailored for proper ignition of the reactive material contained therein depending on the nature of an intended target. Such projectiles may be configured to maintain a simple, robust and yet relatively inexpensive structural design while also exhibiting increased stability and accuracy.

In accordance with one embodiment of the present invention, a projectile is provided. The projectile includes at least one reactive material composition wherein at least a portion of the at least one reactive material defines an unbuffered exterior surface of the projectile. The at least one reactive material composition may include a plurality of reactive materials. In one embodiment, at least two reactive materials may be used, wherein one of the reactive materials is more sensitive to initiation upon impact of the projectile than is the other reactive material.

The at least one reactive material composition may include at least one fuel, at least one oxidizer and at least one binder. The at least one binder may include, for example, a urethane binder, an epoxy binder or a polymer binder. The fuel may include, for example, a metal, an intermetallic material, a thermitic material or combinations thereof.

In one embodiment, the projectile may include a jacket at least partially surrounding the reactive material composition. The jacket may be formed, for example, of a material including copper or steel.

In accordance with another embodiment of the present invention, another projectile is provided. The projectile includes a first reactive material forming a body portion and a second reactive material disposed at a first end of the body portion. The second reactive material is more sensitive to initiation upon impact of the projectile than is the first reactive material. A jacket is disposed substantially about the first reactive material and the second reactive material. The jacket defines an opening adjacent the first reactive material at a second end of the body portion, opposite the first end. A disc hermetically seals the opening defined by the jacket.

In accordance with yet another aspect of the present invention, a method of forming a projectile is provided. The method includes forming a body from at least one reactive material composition and defining at least a portion of an exterior surface of the projectile with the at least one reactive material composition. The method may further include casting the at least one reactive material composition into a desired shape either under vacuum or under pressure. In another embodiment of the invention, the method may include extruding the reactive material composition into a near-net shape and then machining the near-net shape into a desired shape. In yet another embodiment of the invention, the reactive material composition may be pressed into a desired shape, such as under high pressure. The method may further include using any of a variety of compositions for the reactive material compositions and may include forming or defining additional features in the projectile.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
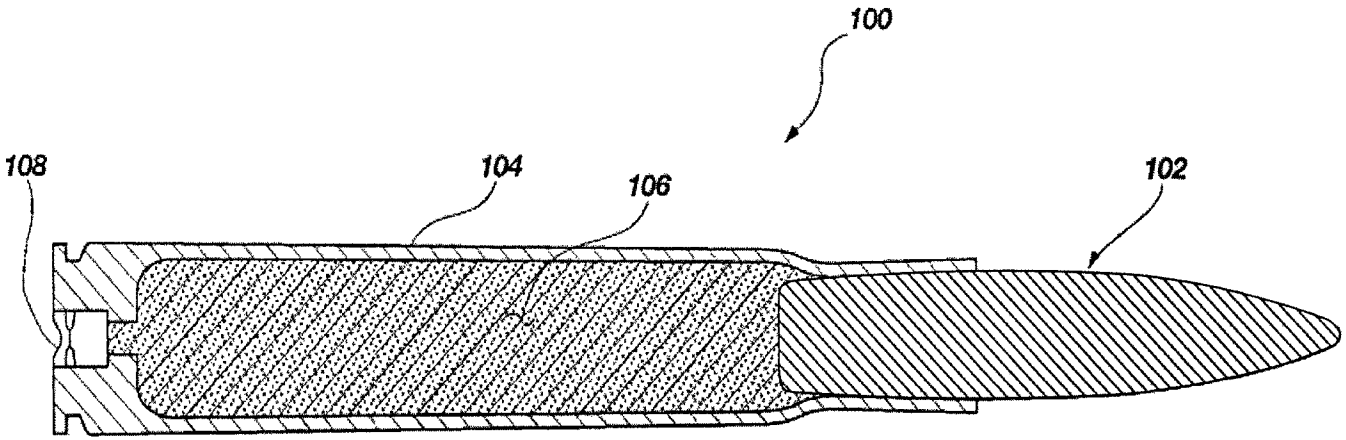
FIG. 1 is a partial cross-sectional side view of a cartridge containing a projectile in accordance with one embodiment of the present invention.

Referring to FIG. 1, an assembled cartridge 100 having a projectile 102 in accordance with one embodiment of the present invention is shown. The cartridge 100 includes a cartridge casing 104 containing, for example, gunpowder or another appropriate conventional propellant composition 106. An initiating or detonation device 108, commonly termed a primer, is in communication with and configured to ignite the propellant composition 106. The projectile 102 is coupled with the cartridge casing 104 such as, for example, by mechanically press-fitting the projectile 102 into an open end of the casing 104.

Upon actuation of the detonation device 108, such as by a firing pin of a gun or other artillery weapon (none shown), the detonation device 108 ignites the propellant composition 106 causing the projectile to be expelled from the casing 104 and from the barrel of a gun, or other weapon in which the cartridge 100 is housed, at a very high rate of speed. For example, in one embodiment, the cartridge may be designed as a .50 caliber round, wherein the projectile 102 may exhibit a muzzle velocity (the velocity of the projectile as it leaves the "muzzle" or barrel of a weapon) of approximately 2,500 to 3,000 feet per second (approximately 760 to 915 meters per second).

Of course, the present invention may be practiced by forming the cartridge 100 and projectile 102 as different sizes such as, for example, 5.56 mm, 7.62 mm, 9 mm, .40 caliber, .45 caliber, 20 mm, 25 mm, 30 mm, 35 mm or other sizes of ammunition.

Figure 2:
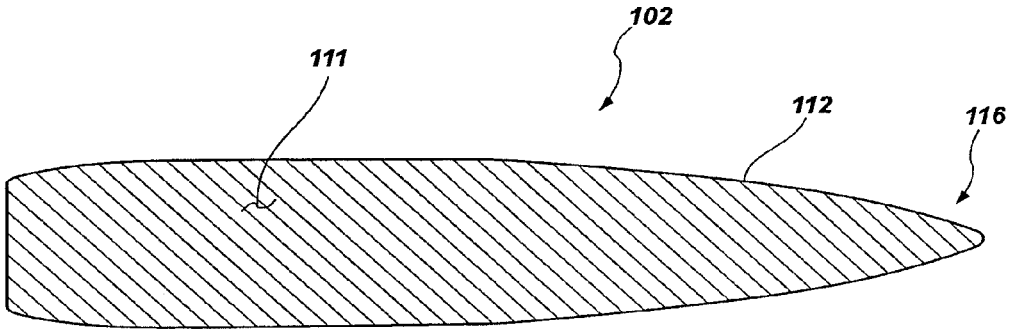
FIG. 2 is an enlarged partial cross-sectional side view of a projectile shown in FIG. 1.

Referring now to FIG. 2, an enlarged cross-sectional view of the projectile 102 is shown. The projectile 102 is formed as a substantially monolithic structure of a desired reactive material 111 composition. The projectile 102 is configured so that the reactive material 111 defines at least a portion of the projectile's exterior surface 112, i.e., the surface that is exposed during firing from a weapon and just prior to impact with an intended target.

In other words, the projectile 102 is configured so that at least a portion thereof is without a buffer between the reactive material and the barrel of a gun or other weapon from which the projectile is launched. Additionally, the projectile 102 is without a buffer between the reactive material from which it is formed and the target with which the projectile 102 is intended to impact. Thus, the projectile 102 is particularly useful against thin-skinned targets wherein the reactive material of the projectile will substantially immediately react, such as by an explosive or incendiary reaction, upon impact with such a target without impediment of such a buffer or casing.

Due to the design of the projectile 102, it will function upon initial impact with various types of targets including, for example, thin-skinned metal targets as well as fiberglass and glass targets. The "unbuffered" reactive material of the projectile 102, such as at the intended leading tip 116 thereof, greatly increases the initiation rate of the reactive material 111 upon impact of the projectile 102 with a given target as compared to reactive materials that are buffered from their target to some degree by a housing, casing or other jacket material. This enables the reactive material 111 to react more readily on thin-skinned targets where other projectiles may penetrate the target without initiating the reactive material contained therein.

Once initiated, the reactive material of the projectile 102 rapidly combusts generating a high overpressure, large amounts of heat, and significant damage to the target impacted thereby. In some applications, the energy release from such a projectile has been determined to have increased energy release, based on plume size and plate (or target) damage, by more than 50% as compared to conventional projectiles with "buffered" reactive or energetic materials contained therein.

The projectile 102 may be utilized in a number of applications, or against a number of intended target types, including, for example, active protection of ships from incoming missiles or projectiles, against aircraft, watercraft, or to damage and initiate combustion of fuel storage containers or fuel tanks on numerous types of vehicles, aircrafts, watercrafts or other structures.

The projectile 102 may be formed using a number of different manufacturing methods or processes using a number of different reactive material compositions. For example, in one embodiment, the projectile 102 may be formed through vacuum or pressure casting wherein the projectile 102 is cast into a mold and the cast composition is cured to produce the monolithic projectile. The cast mold may be cured at ambient (e.g., approximately 70° F. (21° C.)) or it may be cured at an elevated temperature (e.g., greater than approximately 135° F. (57° C.)) to accelerate the cure rate. The cured projectile is then removed from the mold and ready for installation into an associated cartridge or assembled with a housing or casing such as shall be described hereinbelow.

When forming the projectile 102 by casting, various reactive material compositions may be used. For example, the reactive material composition may include urethane binders such as hydroxyl terminated polybutadiene polymer cured with isocyanate curatives such as isophorone diisocynate (IPDI) and a cure catalyst such as dibutyltin diacetate, triphenylbismuth, or dibutyl tin dilaurate.

In another example, an epoxy cure binder system may be used which, in one embodiment, may include a carboxyl terminated polyethyleneglycolsuccinate polymer (such as is known commercially as Witco 1780) cured with a BIS-phenyl A—trifunctional epoxy (ERL 0510) catalyzed with amines, or iron linoleate, or iron octoate. In another embodiment, such an epoxy cure binder system may include a liquid polysulfide polymer cured using one of a variety of epoxy curatives such as a Bis-A epoxy resin (commercially known as Epon 862) or a polyglycol epoxy resin (commercially known as GE 100) and an amine cure accelerator. Other epoxy compositions may also be used.

In yet another example, an energetic polymer binder system may be used which, in one embodiment, may include glycidyl azide polymer (GAP polyol made by 3M) cured with IPDI or a similar curing agent and a cure catalyst such as dibutyltin diacetate, triphenylbismuth, or dibutyl tin dilaurate.

A wide variety of organic polymers may be combined with oxidizers, fuels, reactive materials without oxidizers, intermetallic compositions, theremitic compositions, or combinations thereof.

Examples of oxidizers include ammonium perchlorate, alkali metal perchlorates—such as sodium, barium, calcium, and potassium perchlorate, alkali and alkaline metal nitrates—such as litihium nitrate, sodium nitrate, potassium nitrate, rubidium nitrate, cesium nitrate, strontium nitrate, barium nitrate, barium and strontium peroxides.

Examples of fuels include aluminum, zirconium, magnesium, iron, titanium, sulfur, tin, zinc, copper, indium, gallium, copper, nickel, boron, phosphorous, silicon, tungsten, tantalum, hafnium, and bismuth.

Examples of intermetallic compositions include aluminum/boron, nickel aluminum, zirconium/nickel, titanium/aluminum, platinum/aluminum, palladium/aluminum, tungsten/silicon, nickel/titanium, titanium/silicon, titanium/boron, zirconium aluminum, hafnium/aluminum, cobalt/aluminum, molybdenum/aluminum, hafnium/boron, and zirconium/boron.

Examples of thermitic compositions include iron oxide/aluminum, iron oxide/zirconium, iron oxide/titanium, copper oxide/aluminum, copper oxide/tungsten, aluminum/bismuth oxide, zirconium/bismuth oxide, titanium manganese oxide, titanium/copper oxide, zirconium/tungsten oxide, tantalum/copper oxide, hafnium/copper oxide, hafnium/bismuth oxide, magnesium/copper oxide, zirconium/silicon dioxide, aluminum/molybdenum trioxide, aluminum/silver oxide, aluminum/tin oxide, and aluminum/tungsten oxide.

In accordance with another embodiment of the present invention, the projectile 102 may be formed using extrusion techniques. Using such techniques, the reactive material composition being used to form the projectile may be extruded into a near net shape of the desired projectile and then machined, or hot pressed in a mold, to obtain the desired final dimensions of the projectile 102. Examples of compositions that may be suitable for forming the projectile through extrusion techniques include a combination of a fluoropolymer such as terpolymer of thetrafluoroethylene, hexafluoropropylene and vinylidenefluoride (THV) with a metallic material. Such combinations may include THV and hafnium (Hf), THV and aluminum (Al), THV, nickel (Ni) and aluminum, or THV and tungsten (W). Examples of various polymers that may be used to form the projectile through extrusion techniques include the fluoropolymers set forth in TABLE 1 below. Examples of such compositions, as well as formation of structures by way of extrusion using such compositions, are set forth in U.S. patent application Ser. No. 10/386,617, now U.S. Pat. No. 6,962,634, issued Nov. 8, 2005, entitled LOW TEMPERATURE, EXTRUDABLE, HIGH-DENSITY REACTIVE MATERIALS, assigned to the assignee hereof, the disclosure of which is incorporated herein by reference in its entirety.

TABLE 1

| Fluoropolymers Properties | | | | | |
|---|---|---|---|---|---|
| Polymer | Tensile Strength (psi) at 23° C. | (%) Elongation at 23° C. | Melting Point (° C.) | Solubility | Fluorine Content (% by weight) |
| Polytetrafluoroethylene (PTFE) | | | | | |
| PTFE (TEFLON ®) | 4500 | 400 | 342 | Insoluble | 76 |
| Modified PTFE (TFM 1700) | 5800 | 650 | 342 | Insoluble | 76 |
| Fluoroelastomers (Gums) | | | | | |
| vinylidene fluoride and hexafluoropropylene (Viton ® A) | 2000 | 350 | 260 | Soluble in ketones/esters | 65.9 |
| FEX 5832X terpolymer | 2000 | 200 | 260 | Soluble in ketones/esters | 70.5 |
| Fluorothermoplastic Terpolymer of Tetrafluroethylene, Hexafluoroproplyene, and Vinylidenefluoride (THV) | | | | | |
| THV 220 | 2900 | 600 | 120 | Soluble in ketones/Esters (100%) | 70.5 |
| THV X 310 | 3480 | 500 | 140 | Soluble in ketones/esters (partial) | 71-72 |
| THV 415 | 4060 | 500 | 155 | Soluble in ketones/ esters (partial) | 71-72 |
| THV 500 | 4060 | 500 | 165 | Soluble in ketones/ esters (partial) | 72.4 |
| HTEX 1510 | 4800 | 500 | 165 | Insoluble | 67.0 |
| Fluorothermoplastic Copolymer of Tetrafluoroethylene and Perfluorovinylether (PFA) | | | | | |
| PFA | 4350 | 400 | 310 | Insoluble | 76 |
| Fluorothermoplastic Copolymer of Tetrafluoroethylene and Hexafluoropropylene (FEP) | | | | | |
| FEP | 2900-4300 | 350 | 260 | Insoluble | 76 |
| Fluorothermoplastic Copolymer of Tetrafluoroethylene and Ethylene (ETFE) | | | | | |
| ETFE | 6700 | 325 | 260 | Practically insoluble | 61.0 |

In certain examples, such polymers may be used together, or separately, while also being combined with a number of different fuels and oxidizers including metallic materials or intermetallic compositions such as described hereinabove.

In another example of manufacturing the projectile 102, such may be formed using pressable compositions that are pressed to net shape projectile in a die at high pressures (e.g., above approximately 10,000 pounds per square inch (psi) (approximately 69 megapascals)). Generally, pressable compositions may be produced by decreasing the organic polymer binder and increasing the solid ingredients (e.g., oxidizer/fuel, fuel only, intermetallics, or thermites) of the reactive material composition being used. The various examples of oxidizers, metallics, intermetallics, thermitic compositions and other materials set forth hereinabove may be used.

Additionally, pressable compositions may be formulated using an indium/tin/bismuth (INDALLOY®) composition as a binder that is combined with oxidizers or fuels as set forth hereinabove to produce an energetic or reactive material composition. It is noted that increasing the amount of INDALLOY® binder in the composition can result in the production of a liquid castable composition that may be poured into a hot mold and cooled to form a net shape of the projectile 102. More specific examples of such compositions and uses of such compositions are disclosed in U.S. patent application Ser. No. 10/801,948 entitled REACTIVE MATERIAL ENHANCED MUNITION COMPOSITIONS AND PROJECTILES CONTAINING SAME, U.S. patent application Ser. No. 10/801,946 entitled REACTIVE COMPOSITIONS INCLUDING METAL AND METHODS OF FORMING SAME, and U.S. patent application Ser. No. 11/512,058, now U.S. Pat. No. 7,614,348, issued Nov. 10, 2009, entitled WEAPONS AND WEAPON COMPONENTS INCORPORATING REACTIVE MATERIALS AND RELATED METHODS, each of which applications are assigned to the assignee hereof, the disclosures of each of which applications are incorporated by reference herein in their entireties.

In another example of pressing reactive material compositions, materials such as, for example, fluoropolymers (e.g., PTFE) may be combined with reactive materials as set forth hereinabove and then pressed at a high temperature and sintered. One particular example of such suitable composition includes a composition of aluminum and PTFE. Pellets of such a composition may be pressed and sintered into a near net shape and then machined to produce the desired geometry of the projectile 102.

Some more specific examples of compositions that may be used as pressable compositions include those shown in TABLES 2 and 3 wherein percentages are representative of a weight percent of the specified ingredient.

TABLE 2

| Common Name | Ingredient 1 | Ingredient 2 | Ingredient 3 | Ingredient 4 |
|---|---|---|---|---|
| Al/PTFE | 26% Aluminum | 76% PTFE | | |
| W/PTFE | 71.58% Tungsten | 28.42% PTFE | | |
| Ta/PTFE | 68.44% Tantalum | 31.56% PTFE | | |
| Al/THV220 | 31.6% Aluminum | 68.4% THV220 | | |
| Ta/THV220 | 74% Tantalum | 26% THV220 | | |
| Hf/THV220 | 69.5% Hafnium | 30.% THV220 | | |
| Zr/THV220 | 52.6% Zirconium | 47.4% THV220 | | |
| 10% Al/PTFE | 11.63% Aluminum | 88.37% PTFE | | |
| 25% Al/PTFE | 28.3% Aluminum | 71.7% PTFE | | |
| 40% Al/PTFE | 44.1% Aluminum | 55.9% PTFE | | |
| H95 Al/PTFE | 28.3% Aluminum (H-95) | 71.7% PTFE | | |
| Al/Ti/THV500 | 22.6% Aluminum | 11.93% Titanium | 62.18% THV500 | 3.27% THV220 |
| Ta/THV500 | 73.77% Tantalum | 24.92% THV500 | 1.31% THV220 | |
| Hf/THV500 | 69.14% Hafnium | 29.31% THV500 | 1.54% THV220 | |
| Zr/THV500 | 52.23% Zirconium | 45.38% THV500 | 2.39% THV220 | |
| nano RM4 | 26% Aluminum (nano) | 74% PTFE | | |
| Ta/WO3/THV500 | Tantalum | WO3 | THV500 | THV220 |
| Al coated Hf/PTFE-Stoic | 8.8% Aluminum | 42.9% Hafnium | 48.3% PTFE | |
| Al coated Hf/PTFE-25% | 9.151% Aluminum | 44.679% Hafnium | 46.17% PTFE | |
| Ni/Al/PTFE-IM | 34.255% Nickel | 28.745% Aluminum | 37% PTFE | |
| Ni/Al/PTFE-FR | 34.25% Nickel | 23.2% Aluminum | 42.55% PTFE | |
| Ni/Al/PTFE-Stoic | 25.22% Nickel | 13.78% Aluminum | 61% PTFE | |
| Zr/(35%)THV | 63.85% Zirconium | 34.34% THV500 | 1.81% THV220 | |

TABLE 3

| Common Name | Ingredient 1 | Ingredient 2 | Ingredient 3 | Ingredient 4 | Ingredient 5 | Ingredient 6 | Ingredient 7 |
|---|---|---|---|---|---|---|---|
| CRM W/Kp/Zr-high energy 88-2 | 70% Tungsten | 10% KP | 10% Zirconium | 2.5% Permapol 5534 | 5.81% Epon 862 | 1.69% Epicure 3200 | |
| CRM W/Kp/Zr-high energy 88-4 | 69.33% Tungsten | 9.9% KP | 9.9% Zirconium | 8.15% LP33 | 2.61% Epon 862 | 0.11% Epicure 3200 | |
| CRM W/Kp/Zr 88-7 | 84.25% Tungsten | 4.21% KP | 4.41% Zirconium | 5.49% LP33 | 1.76% Epon 862 | 0.07% Epicure 3200 | |
| CRM W/Kp/Zr 88-4A | 34.83% Tungsten (90 mic) | 34.83% Tungsten (6-8 mic) | 9.95% KP | 9.95% Zirconium | 7.83% LP33 | 2.51% Epon 862 | 0.1% Epicure 3200 |
| CRM W/Kp/Zr 88-4B | 52.5% Tungsten (90 mic) | 17.5% Tungsten (6-8 mic) | 9.9% KP | 9.9% Zirconium | 8.15% LP33 | 2.61% Epon 862 | 0.11% Epicure 3200 |
| CRM Ni/Al epoxy | 57.5% Nickel (3-5 mic) | 26.5% Aluminum (H-5) | 4% Permapol 5534 | 9.3% Epon 862 | 2.7% Epicure 3200 | | |

Figure 3:
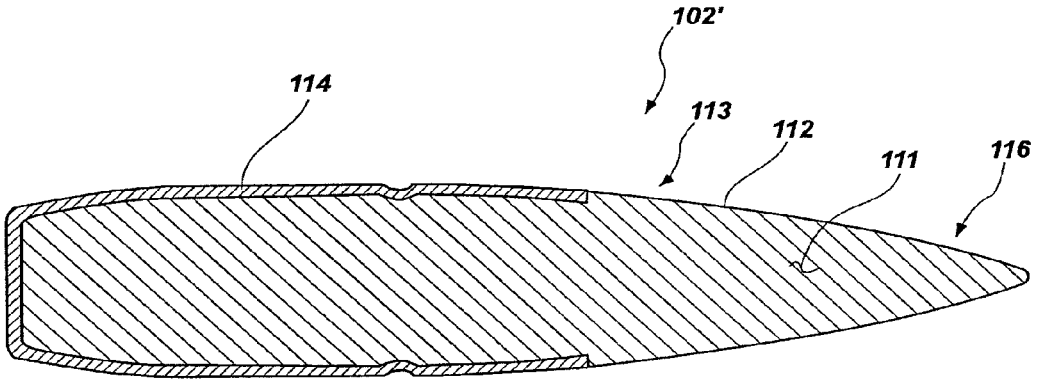
FIG. 3 is a partial cross-sectional view of a projectile in accordance with another embodiment of the present invention.

Referring now to FIG. 3, a projectile 102' in accordance with another embodiment of the invention is shown. The projectile 102' may include a main body portion 113 formed of a reactive material such as has been described hereinabove. Additionally, a jacket 114 or casing may be partially formed about the main body portion 113 to lend additional strength or structural integrity to the projectile 102'. Such added strength or structural enhancement may be desired, for example, depending on the composition of the reactive material used, the size of the projectile 102', or other variables associated with the firing of the projectile 102' and its intended target. Such a jacket 114 may be formed, for example, of a material such as copper or steel.

It is noted that the projectile 102' still includes a portion, most notably the intended leading tip 116, wherein the reactive material 111 is "unbuffered" or exposed to both the barrel of a weapon from which it will be launched and to the target that it is intended to impact. Thus, the projectile 102' retains its rapid reactivity and suitability for thin-skinned targets such as has been discussed hereinabove.

Figure 4:
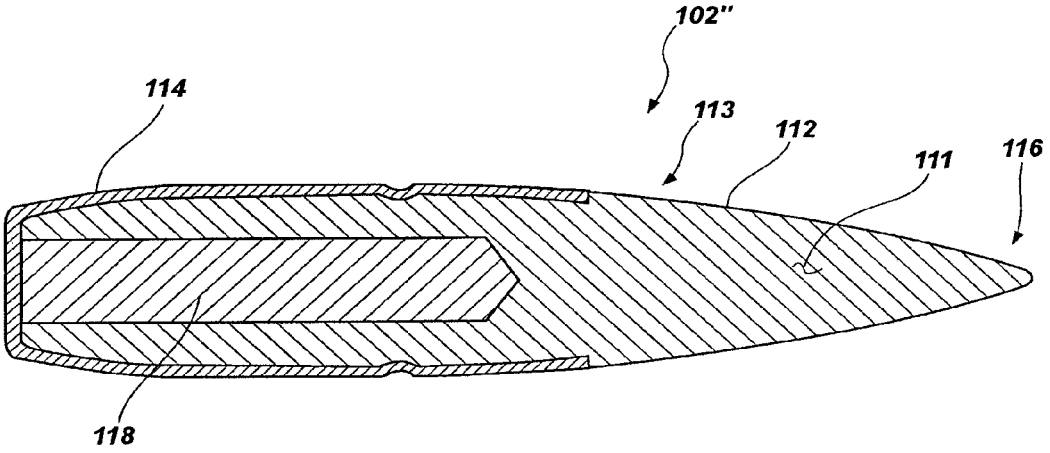
FIG. 4 is a cross-sectional view of a projectile in accordance with yet another embodiment of the present invention.

Referring now to FIG. 4, yet another projectile 102" is shown in accordance with another embodiment of the present invention. The projectile 102" is configured substantially similar to the projectile 102' described in association with FIG. 3, including a main body portion 113 formed of a reactive material 111 and a jacket 114 partially formed thereabout. In addition, the projectile 102" includes a core member 118 disposed substantially within the reactive material 111 of the body portion 112. The core member 118 may be formed as a penetrating member or it may be formed as a second reactive material composition. For example, in one embodiment, the core member 118 may be formed from tungsten or from a material that is denser than that of the reactive material 111 that forms the body portion 113 of the projectile 102". The use of a core member 118 enables the projectile 102" to be tailored to specific applications and for impact with specifically identified targets.

Figure 5:
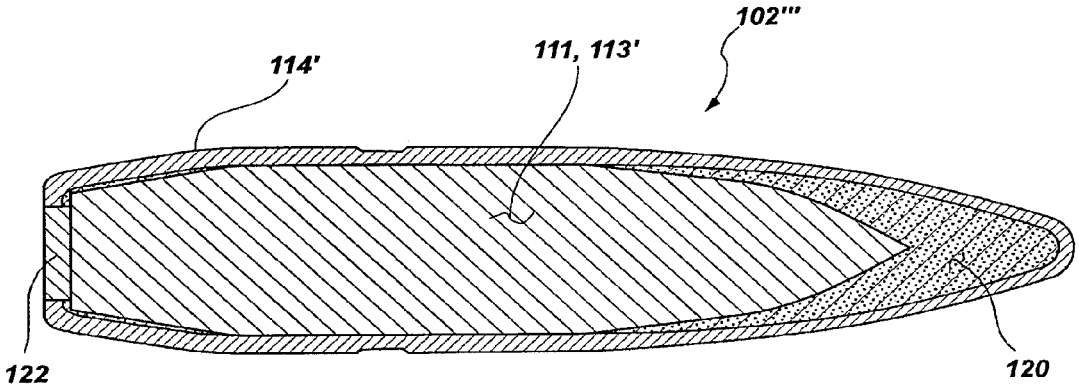
FIG. 5 is a cross-sectional view of a projectile in accordance with yet another embodiment of the present invention.

Referring now to FIG. 5, another projectile 102'" in accordance with yet a further embodiment of the present invention is shown. The projectile 102'" includes a main body portion 113' formed of a reactive material 111 of a desired composition. A second reactive material 120 is disposed and the intended leading end of the projectile 102'" that is more sensitive than the reactive material 111 of the main body portion 113'. A jacket 114' is disposed about and substantially covers the main body portion 113' and the second reactive material 120 and lends structural integrity to the projectile 102'''. A closure disc 122 may be formed at an intended trailing end of the projectile 102''' and placed in a hermetically sealing relationship with the jacket 114' after the reactive material 111 and the second reactive material 120 are disposed therein.

As noted above, the second reactive material 120 may include a material that is more sensitive to initiation (such as upon impact with a target) than the reactive material 111 of the main body portion 113'. Thus, the initiation threshold of the projectile 102''' may be tailored in accordance with an intended use or, more particularly, in anticipation of impact with an intended target type and consideration of the desired damage that is to be inflicted thereon by the projectile 102''', by altering the volume or the composition of the second reactive material 120. In one specific example, the second reactive material may include a copper material.

Of course, in other embodiments, multiple types of reactive material compositions, such as with different levels of sensitivity, may be used without an accompanying jacket, or only with a partial jacket such as has been described herein with respect to FIGS. 3 and 4.

It is further noted that other munitions and components of other munitions, including structural components, may be formed in accordance with various embodiments of the present invention such that, for example, such components typically formed of relatively inert materials may be formed of reactive materials and tailored for a desired reaction depending on the intended use of such components.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A projectile, comprising:

a first reactive material; and a second reactive material disposed at a first end of the first reactive material and proximate an intended leading end of the projectile;

wherein the second reactive material is more sensitive to initiation upon impact of the projectile than is the first reactive material, the first reactive material comprising a tip extending into the second reactive material, the second reactive material directly contacting the first reactive material along a non-planar interface and along substantially all of the tip, wherein all surfaces of the second reactive material directly contact at least one of the first reactive material and an inner surface of a jacket disposed about the second reactive material.

2. The projectile of claim 1, wherein the jacket is disposed about at least a portion of the first reactive material.

3. The projectile of claim 1, wherein the jacket is disposed substantially about the first reactive material and the second reactive material, the jacket defining an opening adjacent the first reactive material at a second end opposite the first end; and a closure hermetically sealing the opening defined by the jacket.

4. The projectile of claim 1, wherein the jacket is formed of a material comprising at least one of copper and steel.

5. The projectile of claim 1, wherein the first reactive material comprises at least one of a fuel, an oxidizer, and a binder.

6. The projectile of claim 1, wherein the second reactive material includes copper.

7. The projectile of claim 1, wherein the first reactive material comprises a first formulation and the second reactive material comprises a second formulation different from the first formulation.

8. The projectile of claim 1, wherein each of the first reactive material and the second reactive material comprises at least one fuel and at least one binder.

9. The projectile of claim 8, wherein the at least one binder comprises at least one of a urethane binder, an epoxy binder and a polymer binder.

10. The projectile of claim 8, wherein the at least one fuel comprises at least one of a metal, an intermetallic material, and a thermitic composition.

11. The projectile of claim 8, wherein at least one of the first reactive material and the second reactive material further comprises at least one oxidizer.

12. The projectile of claim 11, wherein the at least one oxidizer comprises at least one of ammonium perchlorate, an alkali metal perchlorate, lithium nitrate, sodium nitrate, potassium nitrate, rubidium nitrate, cesium nitrate, strontium nitrate, barium nitrate, barium and strontium peroxide.

13. The projectile of claim 1, further comprising a core member.

14. The projectile of claim 13, wherein the core member is substantially surrounded by at least one of the first reactive material and the second reactive material.

15. The projectile of claim 13, wherein the core member comprises a material that is denser than the at least one of the first reactive material and the second reactive material.

16. The projectile of claim 15, wherein the core member comprises tungsten.

17. The projectile of claim 1, wherein the jacket is substantially continuous and substantially covers the first reactive material and the second reactive material, and is disposed about at least a portion of each of the first reactive material and the second reactive material.

18. A method of forming a projectile, the method comprising:

forming a body from at least one reactive material composition comprised of a first reactive material and at least a second reactive material that is more sensitive to initiation upon impact of the projectile than is the first reactive material, wherein the first reactive material is reactive with the at least a second reactive material, forming the body comprising:

forming the at least a second reactive material at a first end of the first reactive material and proximate an intended leading end of the projectile;

forming a tip of the first reactive material extending into the at least a second reactive material and forming the at least a second reactive material directly contacting the first reactive material along a non-planar interface with the first reactive material and along substantially all of the tip; and forming all surfaces of the at least a second reactive material to directly contact at least one of the first reactive material and an inner surface of a jacket disposed about the at least a second reactive material.

19. The method according to claim 18, wherein forming a body further includes casting the at least one reactive material composition into a desired shape.

20. The method according to claim 19, wherein the casting is performed under a vacuum.

21. The method according to claim 19, wherein the casting is performed under pressure.

22. The method according to claim 18, wherein forming a body further includes extruding the at least one reactive material composition.

23. The method according to claim 22, wherein extruding further includes extruding the at least one reactive material into a near-net shape and wherein the method further comprises machining the near-net shape into a desired shape.

24. The method according to claim 18, wherein forming a body further comprises pressing the reactive material composition into a desired shape.

25. The method according to claim 18, wherein forming a body from at least one reactive material composition further includes forming a body portion from a first reactive material and a core member from a second material.

26. The method according to claim 25, wherein forming a body portion from a first reactive material and a core member from a second material includes forming the core member of the at least a second reactive material.

27. The method according to claim 25, wherein forming a body portion from a first reactive material and a core member from a second material includes forming the core member of a material that is denser than the first reactive material.

28. The method according to claim 27, wherein forming a body portion from a first reactive material and a core member from a second material includes forming the core member of a material that includes tungsten.

29. The method according to claim 18, wherein forming a body from at least one reactive material composition further includes providing at least one reactive material composition comprising at least one fuel, at least one oxidizer and at least one binder.

* * * * *

UNITED STATES PATENT AND TRADEMARK OFFICE

CERTIFICATE OF CORRECTION

PATENT NO. : 9,103,641 B2
APPLICATION NO. : 13/372804
DATED : August 11, 2015
INVENTOR(S) : Daniel B. Nielson, Richard M. Truitt and Benjamin N. Ashcroft It is certified that error appears in the above-identified patent and that said Letters Patent is hereby corrected as shown below:

In the specification:

| | | |
|---|---|---|
| COLUMN 1, | LINE 15, | change “Materials;” to --Materials, expired;-- |
| COLUMN 1, | LINE 21, | change “Materials;” to --Materials, expired;-- |
| COLUMN 1, | LINES 32-33, | change “Methods;” to --Methods, expired;-- |

Signed and Sealed this
Nineteenth Day of April, 2016

Michelle K. Lee

Michelle K. Lee
*Director of the United States Patent and Trademark Office*